US007976073B2

(12) United States Patent
Mannucci et al.

(10) Patent No.: US 7,976,073 B2
(45) Date of Patent: Jul. 12, 2011

(54) COUPLING DEVICE

(75) Inventors: Christiano Mannucci, Leghorn (IT); Daniel Marc, Leghorn (IT)

(73) Assignee: Continental Automotive GmbH, Hannover (DE)

( * ) Notice: Subject to any disclaimer, the term of this patent is extended or adjusted under 35 U.S.C. 154(b) by 238 days.

(21) Appl. No.: 12/371,744

(22) Filed: Feb. 16, 2009

(65) Prior Publication Data

US 2009/0230677 A1 Sep. 17, 2009

(30) Foreign Application Priority Data

Feb. 19, 2008 (EP) ..... 08003043

(51) Int. Cl.
*F02M 61/14* (2006.01)

(52) U.S. Cl. ..... 285/353; 123/470

(58) Field of Classification Search ..... 285/353, 285/384, 321, 276; 123/470, 469, 456
See application file for complete search history.

(56) References Cited

U.S. PATENT DOCUMENTS

| | | | | |
|---|---|---|---|---|
| 749,496 | A | 1/1904 | Patterson et al. | 285/67 |
| 2,950,130 | A | 8/1960 | Schneider | 285/67 |
| 3,260,539 | A | 7/1966 | Herron | 285/24 |
| 3,908,621 | A * | 9/1975 | Hussey | 123/456 |
| 4,143,625 | A * | 3/1979 | Kulke | 123/470 |
| 4,213,564 | A * | 7/1980 | Hulsing | 123/470 |
| 4,295,452 | A * | 10/1981 | Lembke et al. | 123/470 |
| 5,765,534 | A * | 6/1998 | Brown et al. | 123/470 |
| 5,943,995 | A * | 8/1999 | Niwa et al. | 123/470 |
| 6,176,221 | B1 * | 1/2001 | Hofmann | 123/470 |
| 6,237,571 | B1 * | 5/2001 | Harrison | 123/469 |
| 6,431,151 | B1 | 8/2002 | Gmelin | 123/470 |
| 6,499,468 | B1 * | 12/2002 | Ferraro et al. | 123/470 |
| 6,543,421 | B2 * | 4/2003 | Lorraine et al. | 123/470 |
| 6,745,753 | B2 * | 6/2004 | Spinnler et al. | 123/456 |
| 6,830,036 | B2 | 12/2004 | Okajima et al. | 123/470 |
| 6,860,008 | B2 | 3/2005 | Bodenhausen et al. | 29/855 |
| 6,877,484 | B2 * | 4/2005 | Reiter | 123/456 |
| 6,923,162 | B2 * | 8/2005 | Reiter | 123/468 |

(Continued)

FOREIGN PATENT DOCUMENTS

DE 19941770 3/2001

(Continued)

OTHER PUBLICATIONS

European Search Report and Written Opinion for Application No. 09000673.5 (6 pages), Jun. 29, 2009.

*Primary Examiner* — David E Bochna
(74) *Attorney, Agent, or Firm* — King & Spalding L.L.P.

(57) ABSTRACT

A coupling device for hydraulically and mechanically coupling a fuel injector to a combustion engine fuel rail has a fuel injector cup with a central longitudinal axis. The fuel injector cup is hydraulically coupled to the rail and engages an injector fuel inlet portion. A first ring element coupled to the cup prevents movement relative to the cup in a central axis direction. The first ring element has a first screw thread. A second ring element is coupled to the injector preventing movement of the second ring element relative to the injector in a central axis direction. The second ring element has a second screw thread in engagement with the first screw thread retaining the fuel injector in the fuel injector cup in central axis direction. One of the ring elements is designed to be rotatable around the central longitudinal axis relative to the injector and/or the cup.

8 Claims, 3 Drawing Sheets

U.S. PATENT DOCUMENTS

| | | | | |
|---|---|---|---|---|
| 7,063,075 | B2 | 6/2006 | Berger et al. | 123/470 |
| 7,195,003 | B2 | 3/2007 | Liskow | 123/470 |
| 7,334,571 | B1 | 2/2008 | Beardmore | 123/470 |
| 7,445,252 | B2 | 11/2008 | Ho | 285/409 |
| 7,516,735 | B1 * | 4/2009 | Doherty et al. | 123/469 |
| 7,591,489 | B2 | 9/2009 | Woo | 285/365 |
| 7,828,338 | B2 | 11/2010 | Kertesz et al. | 285/365 |
| 2002/0100456 | A1 | 8/2002 | Panasuk et al. | 123/456 |
| 2004/0079339 | A1 | 4/2004 | Reiter | |
| 2008/0042434 | A1 | 2/2008 | Kenny | |
| 2008/0169364 | A1 | 7/2008 | Zdroik et al. | 239/533.2 |
| 2009/0229575 | A1 | 9/2009 | Giorgetti et al. | 123/470 |
| 2009/0229576 | A1 | 9/2009 | Biasci et al. | 123/470 |
| 2010/0012093 | A1 | 1/2010 | Pepperine et al. | 123/470 |
| 2010/0018502 | A1 | 1/2010 | Fischetti et al. | 123/470 |
| 2010/0192913 | A1 | 8/2010 | Keidel et al. | 123/470 |

FOREIGN PATENT DOCUMENTS

| | | | |
|---|---|---|---|
| DE | 10108203 | | 8/2002 |
| DE | 102004037117 | A1 | 3/2006 |
| DE | 102005020380 | | 11/2006 |
| DE | 102005024044 | | 11/2006 |
| DE | 102006042597 | | 3/2008 |
| EP | 1255038 | | 11/2002 |
| EP | 1279825 | | 1/2003 |
| EP | 1460264 | | 9/2004 |
| EP | 1818535 | A1 | 8/2007 |
| FR | 2637021 | | 3/1990 |
| FR | 2872252 | A1 | 12/2005 |
| GB | 2024937 | A | 1/1980 |
| JP | 1096464 | | 4/1989 |
| WO | 0118384 | | 3/2001 |
| WO | 03038267 | | 5/2003 |
| WO | WO 03046370 | A1 | 6/2003 |

* cited by examiner

COUPLING DEVICE

CROSS-REFERENCE TO RELATED APPLICATIONS

This application claims priority to EP Patent Application No. 08003043 filed Feb. 19, 2008, the contents of which is incorporated herein by reference in its entirety.

TECHNICAL FIELD

The invention relates to a coupling device for hydraulically and mechanically coupling a fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, wherein the fuel injectors are arranged. The connection of the fuel injectors to the fuel injector cups that supply the fuel from a fuel tank via a low or high-pressure fuel pump needs to be very precise to get a correct injection angle and a sealing of the fuel.

SUMMARY

According to various embodiments, a coupling device for hydraulically and mechanically coupling a fuel injector to a fuel rail can be created which is simply to be manufactured and which facilitates a reliable and precise connection between the fuel injector and the fuel injector cup without a resting of the fuel injector on the cylinder head.

According to an embodiment, a coupling device for hydraulically and mechanically coupling a fuel injector to a fuel rail of a combustion engine, may comprise:

- a fuel injector cup having a central longitudinal axis and being designed to be hydraulically coupled to the fuel rail and to engage a fuel inlet portion of the fuel injector,
- a first ring element being coupled to the fuel injector cup in a way to prevent a movement of the first ring element relative to the fuel injector cup in direction of the central longitudinal axis and the first ring element comprising a first screw thread, and
- a second ring element being coupled to the fuel injector in a way to prevent a movement of the second ring element relative to the fuel injector in direction of the central longitudinal axis and the second ring element comprising a second screw thread being in engagement with the first screw thread to retain the fuel injector in the fuel injector cup in direction of the central longitudinal axis, wherein one of the ring elements is designed to be rotatable around the central longitudinal axis relative to the fuel injector and/or the fuel injector cup.

According to a further embodiment, the first screw thread can be a female screw thread and the second screw thread is a male screw thread. According to a further embodiment, snap rings can be arranged on axially opposing ends of the second ring element and can be designed to enable positive fitting couplings between the snap rings and the fuel injector in axial direction and can be designed to prevent a movement of the second ring element relative to the fuel injector in direction of the central longitudinal axis. According to a further embodiment, the first ring element can be in one part with the fuel injector cup. According to a further embodiment, the second ring element may comprise a collar extending in radial direction.

BRIEF DESCRIPTION OF THE DRAWINGS

Embodiments are explained in the following with the aid of schematic drawings. These are as follows.

Elements of the same design and function that occur in different illustrations are identified by the same reference character.

DETAILED DESCRIPTION

Figure 1:
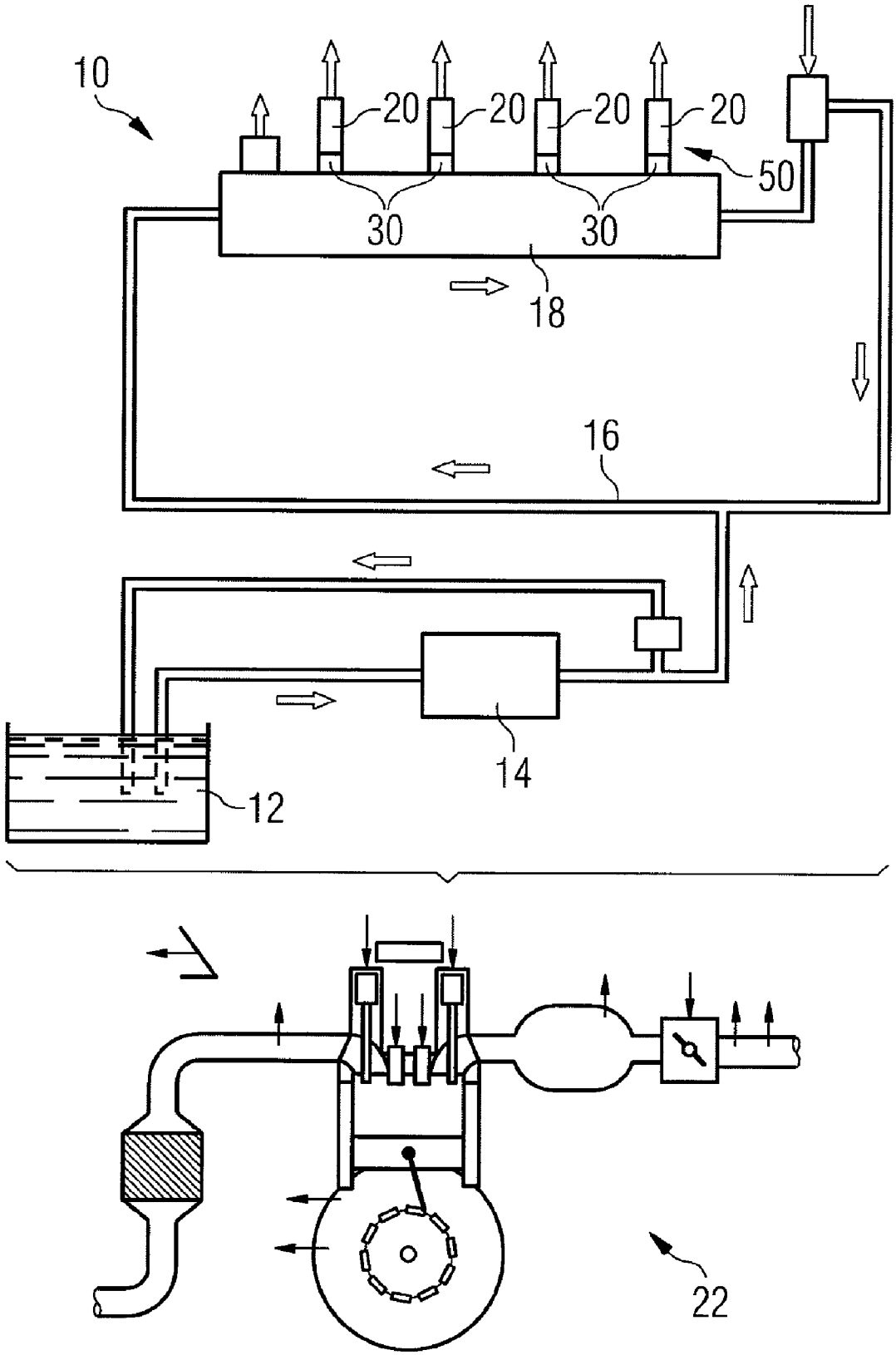
FIG. 1 an internal combustion engine in a schematic view.

The various embodiments are distinguished by a coupling device for hydraulically and mechanically coupling a fuel injector to a fuel rail of a combustion engine. The coupling device comprises a fuel injector cup having a central longitudinal axis and being designed to be hydraulically coupled to the fuel rail and to engage a fuel inlet portion of the fuel injector, a first ring element being coupled to the fuel injector cup in a way to prevent a movement of the first ring element relative to the fuel injector cup in direction of the central longitudinal axis and the first ring element comprising a first screw thread, and a second ring element being coupled to the fuel injector in a way to prevent a movement of the second ring element relative to the fuel injector in direction of the central longitudinal axis and the second ring element comprising a second screw thread being in engagement with the first screw thread to retain the fuel injector in the fuel injector cup in direction of the central longitudinal axis. One of the ring elements is designed to be rotatable around the central longitudinal axis relative to the fuel injector and/or the fuel injector cup.

This has the advantage that a secure coupling between the fuel injector and the fuel injector cup is possible which can withstand even a high fuel pressure. Furthermore, the coupling of the fuel injector with the fuel rail by the ring elements of the fuel injector and the fuel injector cup allows an assembly of the fuel injector and the fuel rail without a further metallic contact between the fuel injector and further parts of the combustion engine. Consequently, a noise transmission between the fuel injector and further parts of the combustion engine can be kept small.

In an embodiment, the first screw thread is a female screw thread and the second screw thread is a male screw thread. This may allow a simple and compact construction of the coupling device which enables to carry out a fast and secure but reversible coupling of the fuel injector to the fuel injector cup.

In a further embodiment, snap rings are arranged on axially opposing ends of the second ring element and are designed to enable positive fitting couplings between the snap rings and the fuel injector in axial direction and are designed to prevent a movement of the second ring element relative to the fuel injector in direction of the central longitudinal axis. By this, an axial movement of the second ring element relative to the fuel injector can be prevented, but a rotational movement of the second ring with respect to the central longitudinal axis is possible. Furthermore, a simple and compact construction for fixing the second ring element in axial direction relative to the injector is enabled.

In a further embodiment, the first ring element is in one part with the fuel injector cup.

This has the advantage that a simple and compact construction of the fuel injector cup is possible. Furthermore, a very secure coupling of the fuel injector to the fuel injector cup is possible. Additionally, a simple machining of the first ring element together with the fuel injector cup is possible.

In a further embodiment, the second ring element comprises a collar extending in radial direction. This allows a good accessibility of the coupling device. Consequently, a simple handling for assembling and disassembling the coupling device is possible, in particular if the collar has a larger radial extension as the first ring element.

A fuel feed device 10 is assigned to an internal combustion engine 22 (FIG. 1) which can be a diesel engine or a gasoline engine. It includes a fuel tank 12 that is connected via a first fuel line to a fuel pump 14. The output of the fuel pump 14 is connected to a fuel inlet 16 of a fuel rail 18. In the fuel rail 18, the fuel is stored for example under a pressure of about 200 bar in the case of a gasoline engine or of about 2,000 bar in the case of a diesel engine. Fuel injectors 20 are connected to the fuel rail 18 and the fuel is fed to the fuel injectors 20 via the fuel rail 18.

Figure 2:
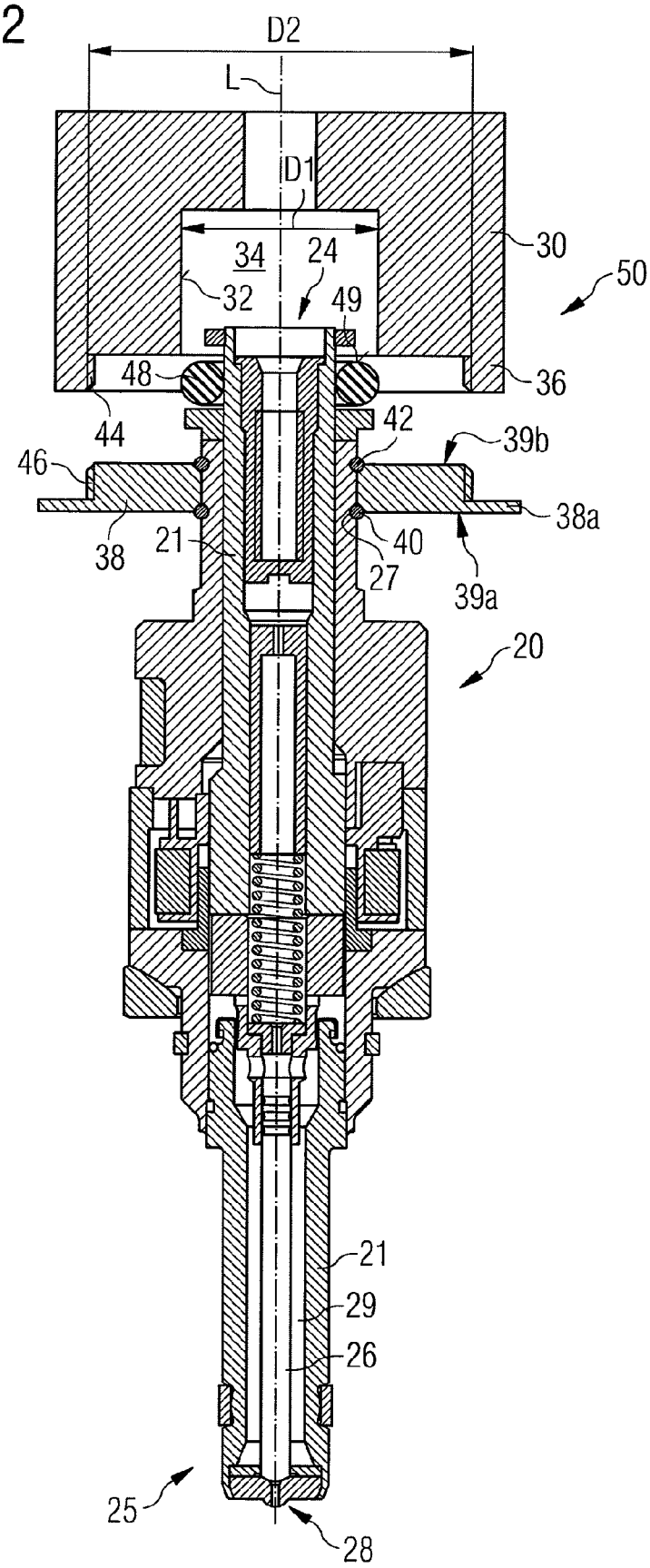
FIG. 2 a longitudinal section through a coupling device and a fuel injector, and FIG. 3 a partial longitudinal section through the coupling device.

FIG. 2 shows the fuel injector 20 in detail. The fuel injector 20 has a fuel injector body 21 and is suitable for injecting fuel into a combustion chamber of the internal combustion engine 22. The fuel injector 20 has a fuel inlet portion 24 and a fuel outlet portion 25. The fuel inlet portion 24 of the fuel injector 20 comprises a sealing ring 48 with an outer surface 49.

Furthermore, the fuel injector 20 comprises a valve needle 26 taken in a cavity 29 of the fuel injector body 21. On a free end of the fuel injector 20 an injection nozzle 28 is formed which is closed or opened by an axial movement of the valve needle 26. In a closing position a fuel flow through the injection nozzle 28 is prevented. In an opening position fuel can flow through the injection nozzle 28 into the combustion chamber of the internal combustion engine 22.

Figure 3:
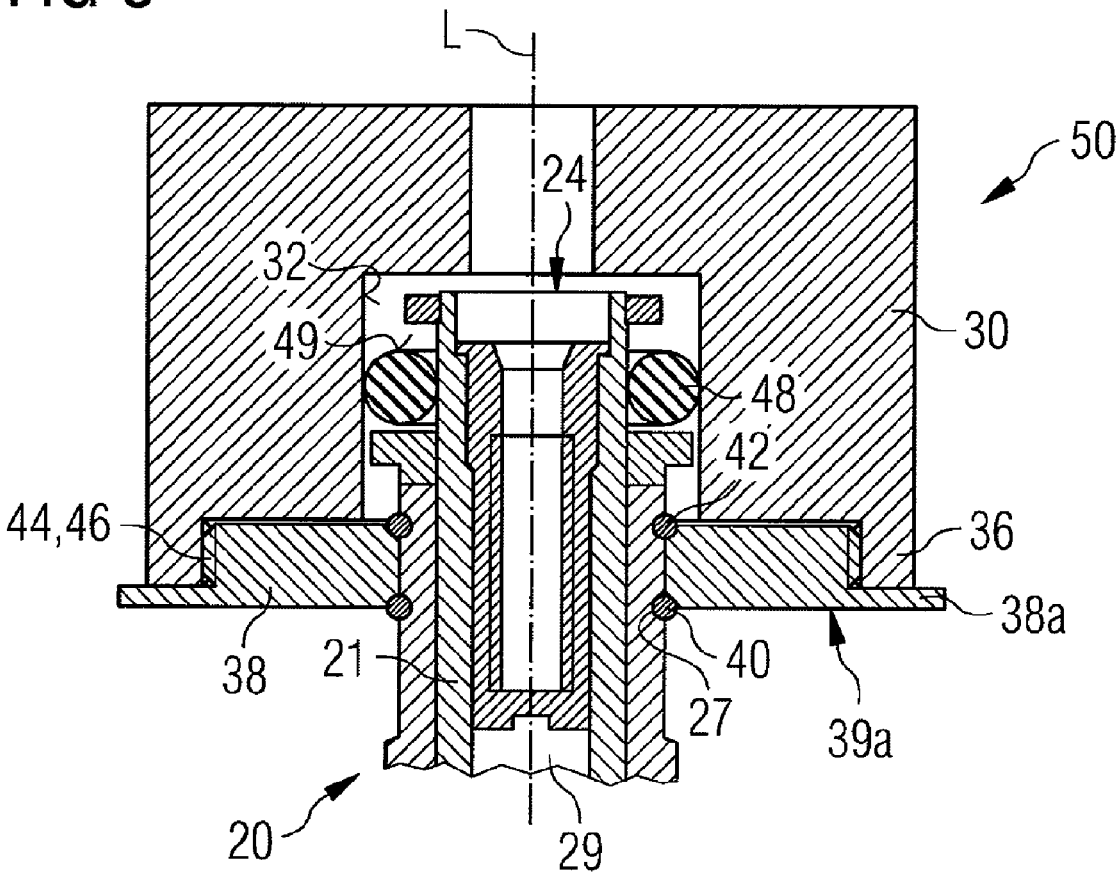

FIGS. 2 and 3 show a coupling device 50 and the fuel injector 20. The coupling device 50 is designed to be coupled to the fuel rail 18 of the internal combustion engine 22. The coupling device 50 has a fuel injector cup 30, a first ring element 36 and a second ring element 38.

The fuel injector cup 30 is in one piece with the first ring element 36. The fuel injector cup 30 has a recess 34 with an inner surface 32. The recess 34 of the fuel injector cup 30 has an inner diameter D1 and is designed to take up the fuel inlet portion 24 of the fuel injector 20. The recess 34 is hydraulically coupled to the fuel rail 18 (FIG. 1). FIG. 3 shows the fuel injector cup 30 being in engagement with the fuel inlet portion 24 of the fuel injector 20.

The first ring element 36 is in one piece with the fuel injector cup 30. The first ring element 36 has a first screw thread 44 which is a female screw thread and has an inner diameter D2. The inner diameter D2 of the first ring element 36 is equal to or larger than the inner diameter D1 of the recess 34 of the fuel injector cup 30.

The second ring element 38 is coupled to the fuel injector 20. The second ring element 38 has a second screw thread 46 being a male screw thread.

The fuel injector 20 has grooves 27. A first snap ring 40 is arranged in one of the grooves 27 of the fuel injector 20 and a second snap ring 42 is arranged in a further groove 27 of the fuel injector 20. The grooves 27 are positioned relative to the second ring element 38 in a way that the first snap ring 40 is positioned at a first axial end 39*a* of the second ring element 38 and the second snap ring 42 is positioned at a second axial end 39*b* of the second ring element 38.

As the snap rings 40, 42 are arranged on opposing axial ends 39*a*, 39*b* of the second ring element 38 the snap rings 40, 42 enable a positive fitting coupling between the second ring element 38 and the fuel injector 20 to prevent an axial movement of the second ring element 38 relative to the fuel injector 20. The second ring element 38 is in a slide contact with the fuel injector 20. This enables a rotational movement of the second ring element 38 relative to the fuel injector 20.

Preferably, the snap rings 40, 42 comprise anti-rotation elements which enable to position the fuel injector 20 in a defined angular orientation relative to combustions chambers of the combustion engine 22.

FIG. 3 shows the assembled coupling device 50. As the first ring element 36 is fixedly coupled to the fuel injector cup 30, the second ring element 38 is coupled to the fuel injector 20 and the first screw thread 44 in an engagement with the second screw thread 46, the fuel injector 20 is retained in the fuel injector cup 30 in direction of the central longitudinal axes L.

The second ring element 38 has a collar 38*a* which extends in radial direction from the central longitudinal axis L. The collar 38*a* allows a good manipulation of the second ring element 38. Consequently, a good processing for assembling and disassembling the second ring element 38 from the first ring element 36 is enabled.

In the following, the assembly and disassembly of the fuel injector 20 with the fuel injector cup 30 with respect to the FIGS. 2 and 3 will be described:

For assembling, the first snap ring 40 is shifted into the appropriate groove 27 of the fuel injector 20, the second ring element 38 is shifted over the fuel injector 20 and the second snap ring 42 is shifted into the further groove 27 of the fuel injector 20. FIG. 2 shows the coupling device 50 after the mounting of the second ring element 38 to the fuel injector 20. The second ring element 38 can rotate around the central longitudinal axis L, but a movement relative to the fuel injector 20 in axial direction is prevented.

Subsequently, the fuel injector cup 30 with the first ring element 36 is shifted over the fuel injector 20 in a way that the fuel inlet portion 24 of the fuel injector 20 is arranged in the recess 34 of the fuel injector cup 30. Then the second ring element 38 is screwed together with the first ring element 26 by a rotational movement of the second ring element 38 around the central longitudinal axis L in a way that the threads 44, 46 of the first ring element 36 and the second ring element 38 come into engagement with each other. FIG. 3 shows the coupling device 50 after the mounting of the fuel injector cup 30 to the fuel injector 20.

After the assembly process a positive fitting coupling of the fuel injector cup 30 with the fuel injector 20 can be obtained. Furthermore, the inner surface 32 of the fuel injector cup 30 is in a sealing engagement with the outer surface 49 of the sealing ring 48 of the fuel injector 20. After the assembly process fuel can flow through the fuel injector cup 30 into the fuel inlet portion 24 of the fuel injector 20 without fuel leakage.

To disassemble the fuel injector 20 from the fuel injector cup 30, the second ring element 38 is unscrewed from the first ring element 36 by a rotational movement of the second ring element 38 around the central longitudinal axis L relative to the fuel injector 20. The threads 44, 46 of the first ring element 36 and the second ring element 38 come out of engagement with each other. In the following, the fuel injector cup 30 can be shifted away from the fuel injector 20 in axial direction and the fuel injector cup 30 and the fuel injector 20 can be separated from each other.

The coupling of the fuel injector 20 with the fuel rail 18 by the ring elements 36, 38 allows an assembly of the fuel injector 20 and the fuel injector cup 30 without a further metallic contact between the fuel injector 20 and the further parts of the internal combustion engine 22. A sealing between the fuel injector body 21 and a combustion chamber of the internal combustion engine 22 can be carried out by a plastic element, in particular by a PTFE element. Consequently, noise transmission between the fuel injector 20 and further parts of the internal combustion engine can be kept small.

What is claimed is:

1. A coupling device for hydraulically and mechanically coupling a fuel injector to a fuel rail of a combustion engine, the coupling device comprising:

a fuel injector cup having a central longitudinal axis and being designed to be hydraulically coupled to the fuel rail and to engage a fuel inlet portion of the fuel injector, a first ring element being coupled to the fuel injector cup in a way to prevent a movement of the first ring element relative to the fuel injector cup in a direction of the central longitudinal axis and the first ring element comprising a first screw thread, a second ring element being coupled to the fuel injector, wherein snap rings are arranged on axially opposing ends of the second ring element and designed to enable positive fitting couplings between the snap rings and the fuel injector in an axial direction and designed to prevent a movement of the second ring element relative to the fuel injector in a direction of the central longitudinal axis and the second ring element comprising a second screw thread being in engagement with the first screw thread to retain the fuel injector in the fuel injector cup in a direction of the central longitudinal axis, wherein one of the ring elements is designed to be rotatable around the central longitudinal axis relative to the fuel injector and/or the fuel injector cup.

2. The coupling device according to claim 1, wherein the first screw thread is a female screw thread and the second screw thread is a male screw thread.

3. The coupling device according to claim 1, wherein the first ring element is in one part with the fuel injector cup.

4. The coupling device according to claim 1, wherein the second ring element comprises a collar extending in a radial direction.

5. A method for hydraulically and mechanically coupling a fuel injector to a fuel rail of a combustion engine, comprising the steps of:

designing a fuel injector cup having a central longitudinal axis to be hydraulically coupled to the fuel rail and to engage a fuel inlet portion of the fuel injector, coupling a first ring element to the fuel injector cup in a way to prevent a movement of the first ring element relative to the fuel injector cup in a direction of the central longitudinal axis wherein the first ring element comprises a first screw thread, and coupling a second ring element to the fuel injector by arranging snap rings on axially opposing ends of the second ring element to enable positive fitting couplings between the snap rings and the fuel injector in an axial direction and to prevent a movement of the second ring element relative to the fuel injector in a direction of the central longitudinal axis wherein the second ring element comprises a second screw thread being in engagement with the first screw thread to retain the fuel injector in the fuel injector cup in direction of the central longitudinal axis, wherein one of the ring elements is designed to be rotatable around the central longitudinal axis relative to the fuel injector and/or the fuel injector cup.

6. The method according to claim 5, wherein the first screw thread is a female screw thread and the second screw thread is a male screw thread.

7. The method according to claim 5, wherein the first ring element is in one part with the fuel injector cup.

8. The method according to claim 5, wherein the second ring element comprises a collar extending in a radial direction.

* * * * *